US007066459B2

(12) United States Patent
Tunkers

(10) Patent No.: US 7,066,459 B2
(45) Date of Patent: Jun. 27, 2006

(54) TOGGLE CLAMPING DEVICE

(75) Inventor: Josef-Gerhard Tunkers, Ratingen (DE)

(73) Assignee: Tunkers Maschinenbau GmbH, Ratingen (DE)

( * ) Notice: Subject to any disclaimer, the term of this patent is extended or adjusted under 35 U.S.C. 154(b) by 258 days.

(21) Appl. No.: 10/381,187

(22) PCT Filed: Apr. 25, 2002

(86) PCT No.: PCT/EP02/04550

§ 371 (c)(1),
(2), (4) Date: Sep. 5, 2003

(87) PCT Pub. No.: WO03/011528

PCT Pub. Date: Feb. 13, 2003

(65) Prior Publication Data

US 2005/0225018 A1 Oct. 13, 2005

(30) Foreign Application Priority Data

Jul. 25, 2001 (DE) ..... 101 36 057

(51) Int. Cl.
*B25B 5/10* (2006.01)

(52) U.S. Cl. ..... 269/240; 269/32

(58) Field of Classification Search ..... 269/32, 269/228, 24–27, 201
See application file for complete search history.

(56) References Cited

U.S. PATENT DOCUMENTS

| | | | | |
|---|---|---|---|---|
| 4,723,767 | A * | 2/1988 | McPherson et al. | 269/32 |
| 5,643,629 | A * | 7/1997 | Sauerland | 427/8 |
| 6,065,743 | A | 5/2000 | Roudier | |
| 6,220,588 | B1 | 4/2001 | Tunkers | |
| 6,439,560 | B1 * | 8/2002 | Sawada et al. | 269/32 |

FOREIGN PATENT DOCUMENTS

| | | |
|---|---|---|
| EP | 0243599 | 11/1987 |

* cited by examiner

*Primary Examiner*—Lee D. Wilson
(74) *Attorney, Agent, or Firm*—Antonelli, Terry, Stout and Kraus, LLP.

(57) ABSTRACT

The invention relates to a toggle lever clamping device, specifically, for use in vehicle body manufacturing in the automobile industry, wherein the rod acting as a piston rod is provided at its end section facing a toggle joint system with a thread by which the rod may be screwed a greater or lesser distance within a sleeve-like component of a linkage element, specifically, a fork head, in order to change the opening angle of a clamping arm. Adjustment of the opening angle may be effected without disassembling the toggle lever clamping device, specifically, for example, by inserting a tool, especially a screwdriver, through a hole in the base cover so as to rotate the piston rod left or right about its longitudinal axis in order to adjust the opening angle. Undesirable rotation is prevented by using a guide plate. A ball screw may also be employed in place of the thread.

13 Claims, 3 Drawing Sheets

TOGGLE CLAMPING DEVICE

The invention relates to a toggle lever clamping device, specifically for use in vehicle body manufacturing in the automobile industry.

PRIOR ART

German Patent 198 24 579 C1 describes a toggle lever clamping device, specifically for use in vehicle body manufacturing in the automobile industry, the device including a clamping head and a cylinder connected to this head as an axial extension, in which cylinder a piston is located so as to be longitudinally movable, rotationally locked, and forming a seal, and to which a pressure means is reciprocatingly and bilaterally applied, the piston together with its piston rod passing through the cylinder and clamping head, a toggle joint system attached to a clamping arm being located at the free end of the piston rod within the housing of the clamping head, the piston subdividing the cylinder into a return stroke cylinder section and a clamping stroke cylinder section, and the clamping stroke cylinder section being sealed by a cover, housing wall or the like at the end face; the toggle lever clamping device including end position sensing devices for the piston in the form of noncontact sensors such as inductive sensors or the like; the toggle lever clamping device including a brake piston or a stop piston which is attached to the piston is and located coaxially to the piston in the same cylinder as the piston; the toggle lever clamping device including an adjustment device in the cylinder base for the brake piston or stop piston, by which adjustment device this piston may be continuously and axially adjusted and locked in both directions from the outside at the cylinder base, without disassembly of the toggle lever clamping device, for the purpose of simultaneously and jointly changing and/or adjusting the opening angle of a clamping arm and the end position sensing device, a sensor of the end position sensing device being attached to the brake piston or stop piston. The adjustment device is designed as a tensioning screw oriented coaxially to the braking and stop piston, which screw is located in a hole in the cylinder base and locked by a lock nut. The adjustment device may also be designed as a linear motor, compressed-air motor, hydraulic motor, electric spindle motor, or a piston-cylinder unit to which a pressure means is applied reciprocatingly and bilaterally. The brake piston, and thus the opening angle, the end position sensing device, and possibly the end position dampening means are adjustable intermittently in steps in the axial direction.

In this toggle lever clamping device, the cylinder end position, the opening angle of a clamping arm, the end position sensing device, and possibly an end position dampening means are simultaneously and jointly set by a setting element. In the event, for example, that the operating conditions change, the only requirement is to readjust the setting by the setting element without disassembling the toggle lever clamping device and its cylinder. The result is that interrelated parameters, that is, cylinder end position, opening angle of the clamping arm, end position sensing, and if necessary end position dampening may be adjusted jointly and simultaneously, and locked in the desired position. This can be accomplished even during operation. This feature is advantageous if, for example, it should become evident that tolerances are not being maintained precisely or that the contours of the clamped parts have changed. In this case, the setting element may be actuated from outside the toggle lever clamping device in order to make the desired adjustments in a single step. This is an inestimable advantage since the result is that there is no down-time on the production lines of the automobile industry which would otherwise entail the high costs of set-up time, etc. In addition, the setting element allows for the desired sensitive adjustments under operating conditions. Since the setting element may be located at a nonobstructive site such as at the cylinder base, the external contour of the toggle lever clamping device is not disadvantageously affected—with the result that the device's universal attachment capability from four sides is retained. There is thus also no need to provide openings in the cylinder, on the clamping head or the like to accommodate sensors, for example. This design instead enables all electrical lines, sensors and dampening elements to be located inside the toggle lever clamping device, for example, in the cylinder and/or the clamping head.

It is evident that in all embodiments the sensors, contacts and electrical lines are protected by being located within the toggle lever clamping device. However, it is also particularly advantageous that using a simple tool the cylinder sensing, opening angle, end position sensing, and if necessary end position dampening may be simultaneously and analogously changed and locked, in other words very quickly and sensitively, while the toggle lever clamping device is mounted.

German Patent 298 11 331 U1 discloses a device for holding, positioning, or clamping, specifically, for holding, positioning, or clamping vehicle body parts, the device including a housing in which a device is located that is translationally movable under the action of an actuating device, and including a clamping and retaining arm, wherein the movable device and the rod of the actuating device are interconnected by a longitudinally adjustable device. The rod of the actuating device has a threaded hole such that the movable device is connected to a connection element having an external thread at one end so as to provide a longitudinal adjustment by screwing the threaded hole in the rod together with the threaded end of the connection element. The connection element is connected so as to be rotationally locked to the movable device. The connection element has a design which interacts with an end position sensing device of the clamping and holding position, the connection element being provided with a lug, the position of which is determinable by a suitable end position sensing device connected to the housing of the device. The rod of the actuating device is rotationally locked to the actuating device, for example, by being fixed to a longitudinal or rectangular piston. The rod and actuating device have a special design which interacts with the end position sensing device to determine the release or opening position. A lug is attached to the rod, the position of which is determinable by an end position sensing device connected to the housing of the device. At least one end position sensing device connected to the housing of the device is a noncontact, preferably inductive, end position sensing unit. The end position sensing devices are located in the same end position sensing module. This design solves the problem of remedying the disadvantages of the prior-art technology referred to in the document, making it possible to adjust paths and angles without disassembly and without modifying the device, with the aim of ensuring good adjustment precision when holding and releasing the held parts. In order to make the adjustment, the piston-cylinder unit must be detached from the clamping head by unscrewing the attachment screws, after which the entire piston-cylinder unit together with the piston rod is rotated around the axis of their external thread. This action accomplishes a step-by-step adjustment of one degree of angle for the clamping and holding degree for each half rotation of the piston-cylinder unit around the screw axis.

This enables the clamping and holding position, as well as the opening and release position, to be adjusted with no intervention being required other than screwing the entire piston-cylinder unit around the threaded rod. As a result, it should be possible to use the same device for a wide usable angular and positioning range.

GOAL

The goal of the invention is to simplify a toggle lever clamping device of the type required in such a way that the rod is adjustable from the outside in the longitudinal direction without any disassembly of the toggle lever clamping device, specifically, without removing the drive unit, so as to set the opening angle of the clamping arm.

SOLUTION

The goal is achieved by the features recited in claims 1 or 2.

SOME ADVANTAGES

In the invention, the piston rod is provided with an external thread at its end facing the clamping head and is screwed a greater or lesser distance by this thread into a sleeve-like component of a linkage element, specifically, a fork head which is connected to the toggle lever clamping device in order to thereby set or change the opening angle of the clamping arm.

A fine-pitched thread, such as an M10×1, or a metric thread, or even an appropriate trapezoidal thread may be employed.

Claim 2 identifies an additional inventive embodiment having a ball screw.

A guide plate is located on the rod, the guide plate having at least two projections on diametrically opposed sides which engage the already present guide grooves for rollers on the toggle joint system, and which extend parallel to the longitudinal axis of the rod and may thus perform the function of rotationally locking the rod.

On the end facing the adjustment device, specifically, a piston-cylinder unit to which a pressure means is applied reciprocatingly and bilaterally by compressed air, a linear motor, a compressed-air motor, a hydraulic motor, an electric spindle motor or the like, the clamping head has a circumferential extension extending perpendicularly to the longitudinal axis at which the guide grooves end, and into which the guide plate with its projections is inserted in the event the spindle has to be adjusted by rotating it about its longitudinal axis.

Unlike prior-art technology, the adjustment device of the invention, for example, a piston-cylinder unit, linear motor or the like, does not have to be unscrewed from the clamping head; instead, the only requirement is either that only a base cover on the side of the adjustment device opposite the clamping head, or a nut located there, needs to be removed—with the result that access is provided through the opening created to insert a screwdriver in order to be able to access the rod and to rotate this rod in either direction so as to adjust the opening angle of the clamping arm after the guide plate has previously inserted itself into the extension. After the adjustment, the guide plate is again retracted into the guide grooves so that the rod remains in a rotationally locked position.

ADDITIONAL EMBODIMENTS OF THE INVENTION

Additional embodiments of the invention are described in claims 3 and 4.

In the embodiment of claim 3, adjustment may be effected by the bottom cover of the adjustment drive unit, for example, by exposing a centric opening through which the rod, provided at one end with a hexagonal socket or a slot, is accessed with a screwdriver in order to rotate the rod in one direction or the other.

Claims 4 and 5 describe advantageous embodiments of the invention.

The drawing provides an illustrative example of the invention, in part in schematic form:

Reference 1 identifies a clamping head consisting of two sandwiched, tightly interfacing casing halves 1*a*, 1*b*, which tightly seal a toggle joint system 2 against dirt and moisture. Toggle joint system 2 is supported by a pivot 3, attached to the housing, inside clamping head 1, and drives a clamping arm 4 which is rotatably driven in directions A or B.

Figures 1, 2:
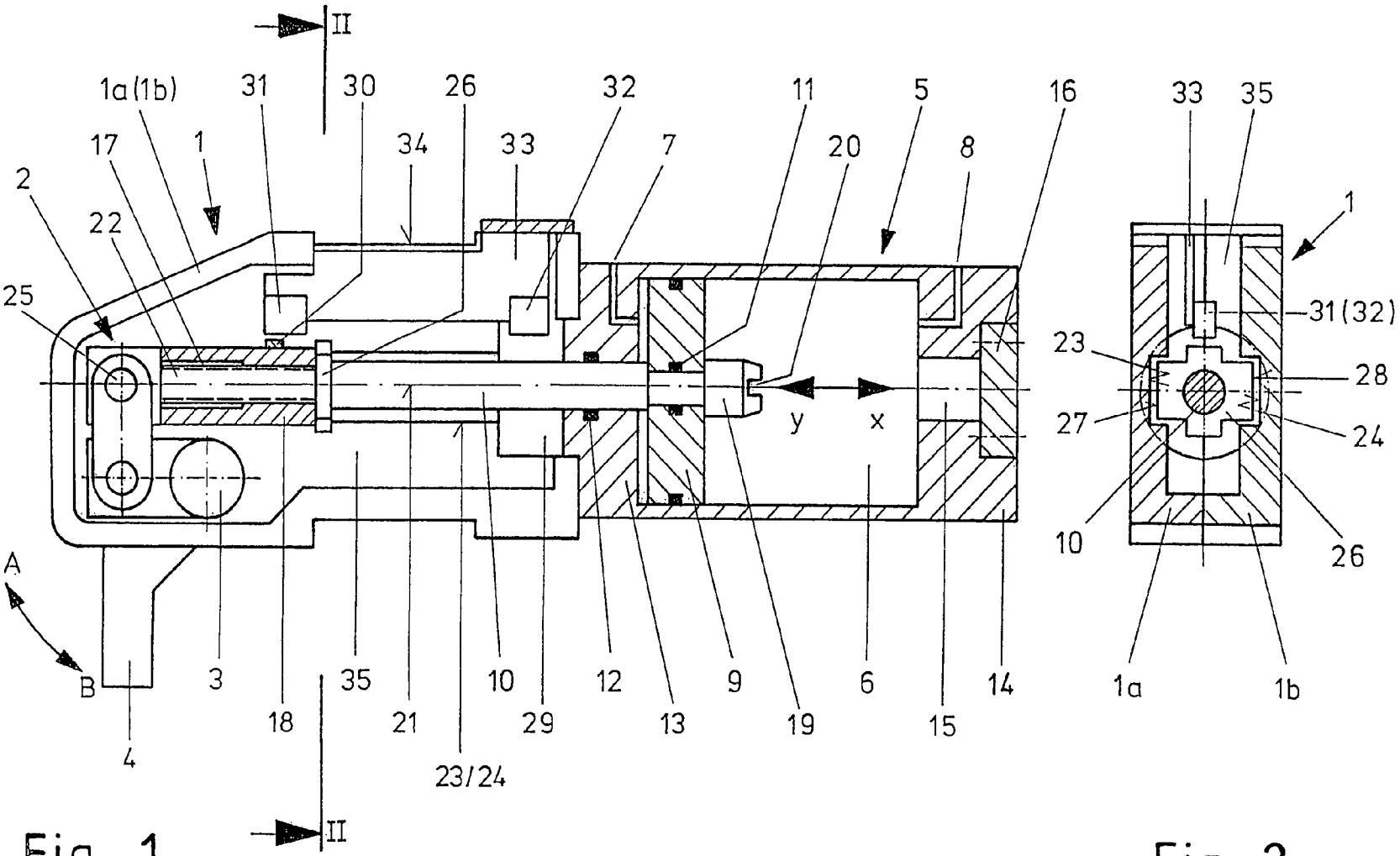
FIG. 1 shows an axial longitudinal section of a toggle lever clamping device from which the casing halves have been removed.
FIG. 2 shows a section through line II—II in FIG. 1.

In the longitudinal direction of clamping head 1, a drive unit 5 is attached to this clamping head, which drive unit in the embodiment of FIGS. 1 and 2 is designed as a piston-cylinder unit. A cylinder identified by 6 has connectors 7 and 8 to connect compressed air lines (not shown) through which compressed air is fed to the piston 9 moving longitudinally within and forming a seal with cylinder 6 so as to drive the piston in a stroke motion in directions X or Y.

A rod designed as a piston rod 10 is connected to piston 9 so as to form a seal. Piston rod 10 extends through a cover 13 while forming a seal with seal 12. Cylinder 6 is closed by a base cover 14 on the side opposite cover 13. Base cover 14 has a centric hole 15 which is sealed from the outside by a plug 16 with screws. Only the center line of the screws is visible.

Piston rod 10 extends through the interior space of clamping head 1 and has at its end opposite piston 9 an external thread 17 along a certain longitudinal section, by which thread the rod is screwed into a sleeve-like linkage element 18. Linkage element 18 may be a fork head which connects, forming a linkage, to toggle joint system 2.

At its end section facing piston 9, piston rod 10 has a thickened head 19 with a recess 20 for connection to a tool not shown, especially to a screwdriver, which is inserted through hole 15 into the interior space of the cylinder after removal of plug 16 in order to rotate piston rod 10 left or right in the manner described about its longitudinal axis 21 so as to screw in or screw out, to a greater or lesser extent, end section 22 containing the thread within sleeve-like linkage element 18. Thread 17 may be either a right-handed or left-handed thread, a fine-pitched thread, or a trapezoidal thread so as to allow piston rod 10 to be sensitively adjusted in the X or Y direction or direction of the stroke. For example, the implementation and configuration of the thread may be such that turning piston rod 10 left or right changes or adjusts the opening angle of clamping arm 4 by one degree or less. In the embodiment shown, for example, the external diameter of thread 17 is twelve mm, while the pitch of thread 17 is one mm on a metric thread.

In the direction of longitudinal axis 21, clamping head 1 is provided with equally sized, parallel guide grooves 23 and 24 oriented symmetrically relative to the longitudinal axis 21 of piston rod 10, in which grooves antifriction-bearing-supported rollers, not shown, such as ball-bearing-supported or needle-bearing-supported rollers, may roll, the rollers being attached to a bolt 25 of toggle joint system 2 in order to provide ease of motion. As is evident in FIG. 2, a guide plate 26 is located on piston rod 10 which loosely engages guide grooves 23 and 24 by projections 27 and 28 and serves to rotationally lock piston rod 10, and thus toggle joint system 2. In response to axial displacement in the X direction and after entering free space 29 around longitudinal axis 21, guide plate 26 is able to rotate around either to the right or left since guide grooves 23 and 24 terminate in free space 29 of fork head 1.

Connected to linkage element 18 is a switching lug 30 which interacts with sensors 31 and 32, thereby indicating the position of piston rod 10, and thus indirectly the opening angle of clamping arm 4. Sensors 31 and 32 may be appropriate inductive sensors, microswitches, or even pneumatic switches if required. Sensors 31 and 32 may be located on a board 33, shown only schematically, provided as a replaceable unit which may be inserted through a slot 34 on the back of the toggle lever clamping device into the interior space 35 of clamping head 1. Slot 34 is oriented in the direction of longitudinal axis 21, and in the embodiment shown is symmetrically shared by the two casing halves 1*a* and 1*b* of clamping head 1. Slot 34 is sealed off from the outside by board 33 to protect against dirt and dust, and as far as possible against moisture, so that as far as possible no contamination may enter through slot 34 into interior space 35 of clamping head 1. The design and arrangement of the board may otherwise be selected to match those described and presented in German Patent 196 16 441 C1 (0 803 331 B1).

In the embodiment shown in FIGS. 1 and 2, adjustment of the opening angle proceeds as follows:

Piston 9 is moved in direction X until guide plate 26 enters free space 29. After plug 16 is removed, a screwdriver may be inserted into recess 20 of piston rod 10 to rotate the rod around to the left or right so as change the opening angle of clamping arm 4. Guide plate 26 is then reinserted into guide grooves 23 and 24 and thereby locked against rotation. Clamping arm 4 has thus been set to a new opening angle. Plug 16 is returned to its closed position and secured. The adjustment of the opening angle is thus effected from the back of drive unit 5 without any requirement of disassembling the toggle lever clamping device. As a result, the opening angle of clamping arm 4 may be sensitively adjusted with only a few motions in the installed condition, without any disassembly of the device, and locked in any desired position.

Figure 3:
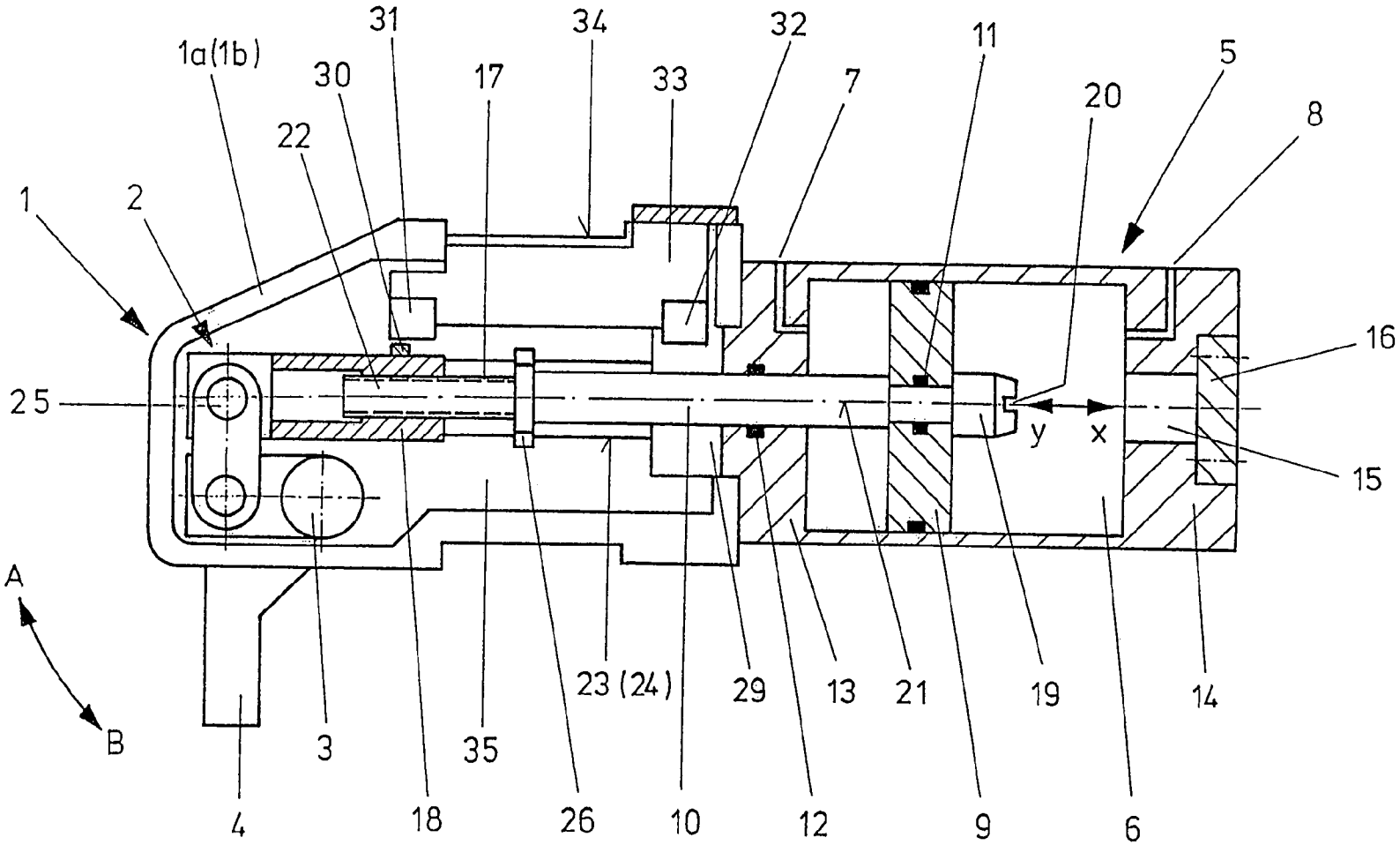
FIG. 3 shows the toggle lever clamping devices of FIGS. 1 and 2 after the piston rod has been adjusted and relocked.
Figure 4:
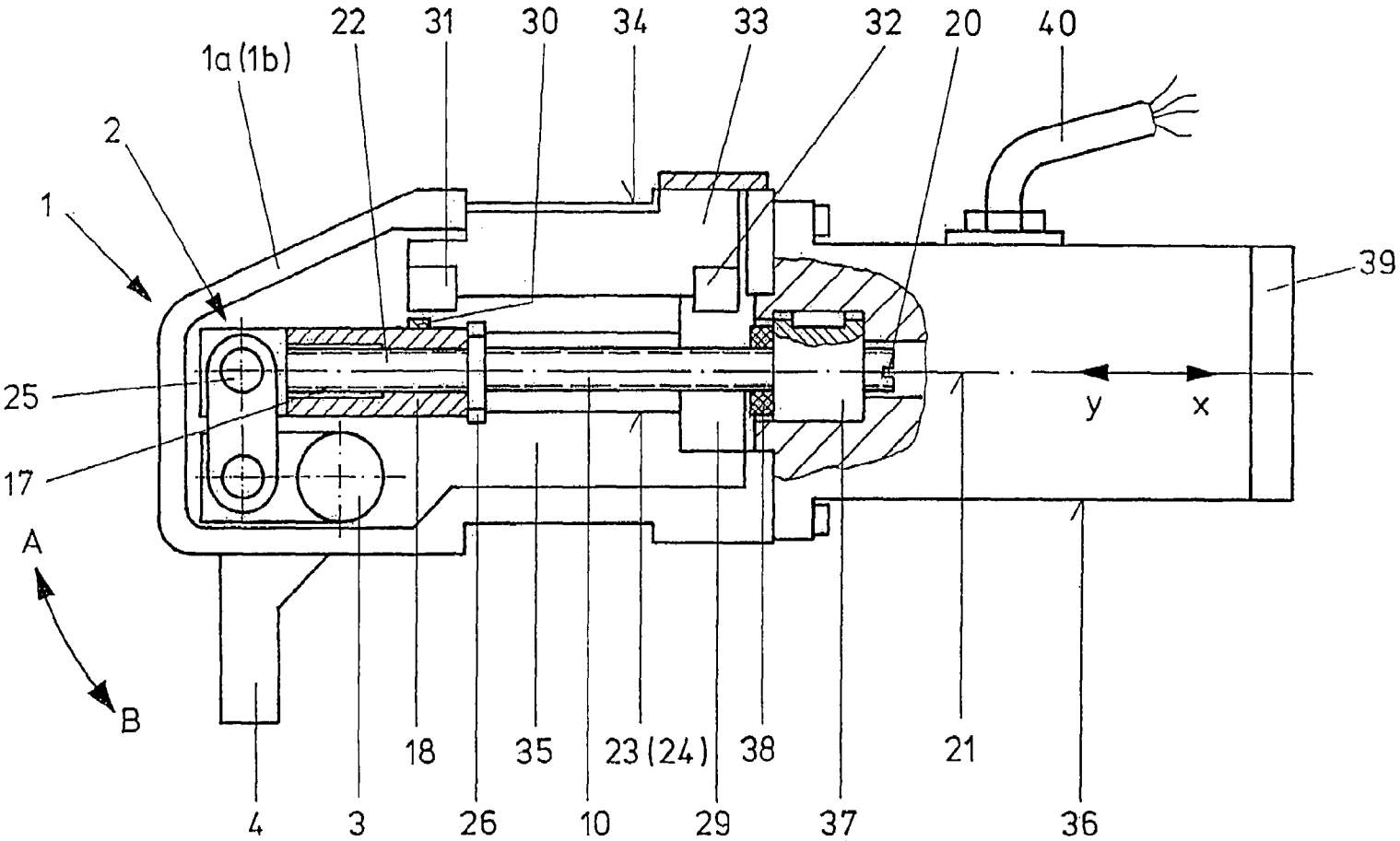
FIG. 4 shows a toggle lever clamping device with a ball screw equipped with an electric motor as the drive unit, partially in a side view, partially in cross-section.

In FIG. 4, the invention is described as applied to another embodiment. The reference numbers found in FIGS. 1 through 3 are employed for components having the same function.

Reference number 36 indicates a stator of an electric motor, details of which are not shown, to which a rotor 37 is attached, the rotor having a screw nut, details of which are not shown, which nut meshes with thread 17 of rod 10 in the form of a ball screw. It is also possible here to employ a metric thread, a Whitworth thread, or a spindle with a trapezoidal thread. The screw nut of rotor 37 also meshes with the appropriate transfer elements which drive ball screw 10 in directions X or Y, while the nut itself, and thus rotor 37, remains stationary since it is fixed in stator 36 such that only ball screw 10 moves back and forth in directions Y or X, as driven by the electric motor, the ball screw being screwed in or out a greater or lesser distance within the screw nut of rotor 37, thereby moving clamping arm 4 analogously.

Reference number 38 indicates a shock absorber which is intended to prevent guide plate 26 from striking rotor housing 37 or its nut with excessive force. The shock absorber may consist of a body with rubber-elastic properties such as a polyurethane material.

Stator 36 may be closed off at one end by a base cover 39 using screws (not shown) so as to allow ball screw 10 to be appropriately screwed in or out a greater or lesser distance within the screw nut by a tool such as a screwdriver after guide plate 26 has moved into free space 29, thereby changing the opening angle.

Reference number 40 indicates an electric wire to supply electric power.

The features found in the abstract, in the claims, and in the description, as well as in the drawings, may be essential to reducing the invention to practice, either individually or in any combination.

LIST OF REFERENCE NUMERALS

1 clamping head
1*a* half casing
1*b* "
2 toggle joint system
3 pivot
4 clamping arm
5 drive unit
6 cylinder
7 connector
8 "
9 piston
10 rod, piston rod, ball screw
11 seal
12 "
13 cover
14 base cover
15 hole, centric
16 plug
17 external thread
18 linkage element
19 head
20 recess
21 longitudinal axis
22 end section
23 guide groove
24 "
25 bolt
26 guide plate
27 projection, lateral
28 "
29 free space
30 switching lug
31 sensor
32 "
33 board
34 slot
35 interior space
36 stator
37 rotor

38 shock absorber
39 base cover
40 electrical wire
A pivot direction of clamping arm 4
B " " " "
X stroke direction of rod 10 and of piston 9
Y " " " " " "

LIST OF REFERENCES

German examined application 22 22 686
German examined application 29 26 258
German unexamined application 24 31 706
German unexamined application 25 19 251
German unexamined application 25 55 207
German unexamined application 27 18 639
German unexamined application 41 11 430
German unexamined application 42 42 601
German Patent 24 48 028
German Patent 28 28 344
German Patent 30 22 376
German Patent 34 03 961
German Patent 196 16 441
German Patent 198 24 579
German Utility Model 87 14 390
German Utility Model 89 08 288.5
German Utility Model 90 05 183.1
German Utility Model 90 16 781.3
German Utility Model 91 04 532.0
German Utility Model 91 05 755.8
German Utility Model 92 15 151.5
German Utility Model 93 11 132.0
German Utility Model 295 04 267
German Utility Model 295 13 586.7
German Utility Model 295 19 232.1
German Utility Model 297 00 891
German Utility Model 297 18 644.2
German Utility Model 298 11 331
EP-A-0 005 407
EP-A-0 080 565
EP-A-0 256 208
EP-A-0 313 767
EP-A-0 317 924
EP-A-0 359 073
EP-A-0 417 024
EP-A-0 433 601
EP-A-0 595 074
EP-A-0 636 449
EP-A-0 648 941
EP-A-0 695 603
EP-A-0 778 107
EP-B-0 803 331
EP-A-0 962 285
WO-A-92/08899
GB-A-1,413,751
GB-A-495,563
FR-A-2,427,179
FR-A-2,431,625
FR-A-2,618,718
Japanese examined application 9548/73
U.S. Pat. No. 2,980,387
U.S. Pat. No. 2,983,256
U.S. Pat. No. 2,985,140
U.S. Pat. No. 3,180,236
U.S. Pat. No. 3,371,953
U.S. Pat. No. 3,482,831
U.S. Pat. No. 3,815,480
U.S. Pat. No. 3,961,559
U.S. Pat. No. 3,994,539
U.S. Pat. No. 4,240,620
U.S. Pat. No. 4,424,737
U.S. Pat. No. 4,429,715
U.S. Pat. No. 4,664,364
U.S. Pat. No. 4,700,611
U.S. Pat. No. 4,905,973
U.S. Pat. No. 5,072,652
U.S. Pat. No. 5,171,001
U.S. Pat. No. 5,201,838
U.S. Pat. No. 6,220,588
U.S. Ser. No. 08/759,518
"*Spanntechnik*"["Stretching Technology"] Catalog, DE-STA-CO company, Frankfurt 1972/1973, pp. 72/73
Brochure by the company ISI Anlagen- und Komponenten Vertriebs GmbH: "*Neue Kraft in der Greifertechnik. Nur von ISI.*" ["New Strength in Gripping Technology. Only from ISI."
"Quick Change Gripper Head Mounts" from the company ISI Manufacturing, Inc.
Brochure by the company ISI Manufacturing, Inc., "Other ISI Products," in particular "*Das Grip-Lok System: Bewährte Greifertechnik*" ["The Grip-Lok System: Proven Gripping Technology"
Data sheets KG84A32101, KG84A32102, KG84A32103, KG84A32104 from the DE-STA-CO Metallerzeugnisse GmbH company on "*Kurvenklemmgreifer, Einfachklemmgreifer, Doppelklemmgreifer*" ["Curved Grippers, Single Grippers, Double Grippers"]
Brochure from the Sommer Automatic GmbH Company: "Kniehebelgreifer [Toggle Lever Grippers] GK 20, GK 25"
Brochure from the Fritz Schunk GmbH Company: "Kniehebeigreifer [Toggle Lever Grippers] Type PKG, pneumatic"
Brochure from the Fritz Schunk GmbH Company: "15.2" and "15.3"

The invention claimed is:

1. Toggle lever clamping device, comprising:

a clamping head and a drive unit connected in the axial direction to the clamping head which drive unit drives a rod back and forth in the longitudinal direction of the rod which is coupled to a toggle joint system by a linkage element, the toggle joint system driving a clamping arm pivotably back and forth, and the rod being connected to the linkage element by a thread so as to be longitudinally adjustable in both directions, wherein a) the rod which is provided on its end section facing the toggle joint system with an external thread is screwed into a hole of the linkage element, which hole is provided with an internal thread;

b) the rod is rotatable in both directions about the longitudinal axis of the rod through a hole in a base cover at the end opposite the clamping head for the purpose of axially adjusting the rod;

c) a guide plate is located on the rod, which guide plate engages diametrically opposing projections in guide grooves of the clamping head which guide guide rollers of a bolt in the longitudinal direction of the clamping head;

d) a free space is located in the end section facing the drive unit, the extensions of which free space measured perpendicularly to the longitudinal axis of the rod are greater than the transverse dimensions of the guide plate measured in this direction.

2. Toggle lever clamping device, comprising:

a clamping head and a drive unit in the form of an electric motor connected in the axial direction to the clamping head, which drive unit drives a rod in the form of a ball screw back and forth in the longitudinal direction of the rod which is coupled to a toggle joint system by a linkage element, the toggle joint system driving a clamping arm pivotably back and forth, the ball screw being connected to the linkage element so as to be longitudinally adjustable in both directions, wherein a) the ball screw meshes with a screw nut located so as to be locally immovable within the stator, and wherein the ball screw is adjustable in both directions at the end of the ball screw opposite the clamping head, by rotating the ball screw for the purpose of adjusting the opening angle of the clamping arm;

b) a guide plate is located on the rod, which guide plate engages diametrically opposing projections in guide grooves of the clamping head which guide guide rollers of a bolt in the longitudinal direction of the clamping head;

c) a free space is located in the end section facing the drive unit, the extensions of which free space measured perpendicularly to the longitudinal axis of the rod are greater than the transverse dimensions of the guide plate measured in this direction.

3. Toggle lever clamping device according to claim 1, characterized in that the rod has a recess at an end of the rod facing the base cover to accept a tool.

4. Toggle lever clamping device according to claim 1, characterized in that the drive unit is a piston-cylinder unit.

5. Toggle lever clamping device according to claim 1, characterized in that the drive unit is a linear motor or an electric motor.

6. Toggle lever clamping device according to claim 1, characterized in that the linkage element is a connecting rod or fork head.

7. Toggle lever clamping device according to claim 1, wherein the external thread on the rod is selected from the group consisting of a metric thread, a Whitworth thread and a trapezoidal thread.

8. Toggle lever clamping device according to claim 1, characterized in that the guide plate has a rectangular shape, viewing the rod axially, and is provided with longitudinal sections perpendicular to the longitudinal axis of the rod that extend into diametrically opposite guide grooves which form the projections.

9. Toggle lever clamping device according to claim 2, characterized in that a shock absorber which constrains the stroke of the guide plate is located in the area between the free space and the rotor.

10. Toggle lever clamping device according to claim 2, characterized in that the rod has a recess at an end of the rod facing the base cover to accept a tool.

11. Toggle lever clamping device according to claim 2, characterized in that the guide plate has a rectangular shape, viewing the rod axially, and is provided with longitudinal sections perpendicular to the longitudinal axis of the rod that extend into diametrically opposite guide grooves which form the projections.

12. Toggle lever clamping device according to claim 2, characterized in that the linkage element is a connecting rod or fork head.

13. Toggle lever clamping device according to claim 2, further comprising a base cover having a hole at an end opposite the clamping head through which a tool may be inserted for adjusting the ball screw, and a removable base cover for covering the hole.

* * * * *